United States Patent [19]

Sivachenko

[11] 4,211,504

[45] Jul. 8, 1980

[54] HIGH STRENGTH CORRUGATED METAL PLATE AND METHOD OF FABRICATING SAME

[76] Inventor: Eugene W. Sivachenko, 6851 Waverly, Redding, Calif. 96001

[21] Appl. No.: 900,383

[22] Filed: Apr. 26, 1978

Related U.S. Application Data

[62] Division of Ser. No. 699,289, Jun. 24, 1976, Pat. No. 4,099,359.

[51] Int. Cl.[2] ..... E02D 5/00

[52] U.S. Cl. ..... 405/284; 405/124; 405/150; 52/86

[58] Field of Search ..... 405/284, 285, 286, 132, 405/140, 146, 124, 125, 150; 52/80, 537, 90, 351, 86

[56] References Cited

U.S. PATENT DOCUMENTS

| | | | |
|---|---|---|---|
| 1,664,646 | 4/1928 | Sweet | 405/132 |
| 1,928,480 | 9/1933 | Carswell et al. | 405/124 |
| 3,187,852 | 6/1965 | Carman et al. | 52/86 |
| 3,282,056 | 11/1966 | Fisher | 405/286 |
| 3,820,295 | 6/1974 | Folley | 52/90 |

FOREIGN PATENT DOCUMENTS

| | | | |
|---|---|---|---|
| 602348 | 5/1948 | United Kingdom | 405/284 |

*Primary Examiner*—Dennis L. Taylor
*Attorney, Agent, or Firm*—Townsend and Townsend

[57] ABSTRACT

Corrugated steel plate is formed from a flat plate stock and has a length of at least about 12 feet, a corrugation pitch of at least about 12 inches, and a corrugation depth of at least four inches. The plate has thicknesses of up to ½ inch and more. Also disclosed are structures such as tunnel-type, heavy load-supporting structures defined by upright and horizontal structure portions which extend over no more than about 180° while being capable of supporting up to 40 feet of ground fill and payload thereon. The corrugated plate can be used singly or as double, spaced-apart plate assemblies which are hollow or filled with concrete or a like material, including steel reinforcing bars for the concrete. The corrugated plate can also be formed into vertical, sectional retaining walls, bin type retaining walls, bridge abuttment walls, flat support surfaces such as bridge decking, open air structures, guard rails, sheet piling, etc.

5 Claims, 20 Drawing Figures

HIGH STRENGTH CORRUGATED METAL PLATE AND METHOD OF FABRICATING SAME

This is a division of application Ser. No. 699,289, filed June 24, 1976, now U.S. Pat. No. 4,099,359.

BACKGROUND OF THE INVENTION

Large load-supporting structural surfaces, either vertical, horizontal or a combination of both, are in universal and widespread use. These structures must support their own weight and, normally, very large loads such as layers of ground and soil of as much as 30 to 40 or more feet high, heavy payloads such as bridge traffic and the like. Since these structures are necessarily large, that is since they have long, essentially unsupported spans of as much as 50 to 100 feet in length and more they are subjected to very large forces and deflections which could in the past only be handled with elaborate fabricated support beams and trusses, with massive reinforced concrete walls and beams, or with a combination of both.

Fabricated steel structures, though not excessively heavy, are expensive because they use a relatively large amount of expensive material, e.g., high quality steel which must be tediously fabricated, assembled and installed from a multiplicity of different, individually fabricated members such as I-beams, angle irons, plates and the like welded, riveted or bolted together. Furthermore, to obtain the necessary strength such structures required a great depth, often of many feet, which might not be available, or which is only available at significant costs, e.g., by performing expensive excavation and the like.

As an alternative to such fabricated metal structures, reinforced concrete has found increasing acceptance. Frequently the concrete structures are aesthetically more appealing and they are often less expensive. Nevertheless, they require the erection of complicated forms and the installation of the necessary reinforcing steel bars all of which requires individual, on-the-site fabrication, assembly and installation by skilled and, therefore, costly craftsmen.

After the necessary large volume of concrete has been poured into the forms and the forms have been dismantled the concrete structures are again quite expensive. Moreover, they too have to be massive to support a given load.

To overcome some of these shortcomings and to reduce construction costs, it has in the past been suggested to employ prefabricated plate, normally steel plate elements. Since plate as such is weak, that is since it cannot withstand large forces acting perpendicular to the plate, it has also been suggested to employ corrugated plate structures. Examples of such constructions are disclosed, for example, in U.S. Pat. Nos. 2,126,091; 2,536,759; 3,508,406; and 3,638,434.

The referenced patents disclose tunnel-like, load-supporting structures made of corrugated plate, that is relatively short sections of corrugated plate normally having corrugations with a pitch of up to six inches, a corrugation depth up to two inches, and a wall thickness of up to ⅜ inch. For the contemplated large structures, which have a width (perpendicular to the tunnel defined by the structure) of up to 60 feet and more, it is necessary to include stiffening members which rigidify the structure both for load-bearing purposes and for maintaining the structure in the desired, e.g., normally arched shape during the backfilling and compacting process. Even then such structures exhibit relatively little load, e.g., ground supporting capacity unless the structure is reinforced with suitable stiffeners and the like. As a consequence, these structures, though relatively less expensive because they could be assembled from uniform, prefabricated modules, i.e. like, prefabricated and, where applicable, curved corrugated plate elements, their relatively low strength limited their application to relatively short span lengths and relatively small loads. For example, typical highway overpasses which have to accommodate a ground fill height of 10 to 30 and more feet as well as a large payload such as a standard California State Highway surcharge of H20 (for standard freeway traffic) must be built as before from fabricated steel and/or reinforced concrete both of which renders such structures relatively expensive.

In other instances in which relatively long, load-bearing spans are required, such as in large bulk material, e.g., gravel storage bins, bin type retaining walls were suspended between upright posts and constructed of multiple, prefabricated, U-shaped members made from steel plate of the appropriate thickness which was press-formed to the desired shape. By providing the resulting U-shaped channel members with the appropriate depth the required strength could be obtained. The inherent shortcoming of this approach is that the maximum span length is limited by the effective length of the longest available press. Moreover, such fabrication method is tedious, each channel member must be separately fabricated and thereafter the channel members must be assembled, usually bolted together in a side-by-side relationship to form a wall of the desired height. The resulting structure, though having adequate strength but not necessarily an adequate length, was relatively expensive.

Thus, the prior art applicable to structures here under consideration, that is structures having relatively large load-bearing surfaces that are unsupported between ends of the surfaces such as are found in bridge, tunnel or retaining wall constructions, can be summarized as relying on fabricated steel or reinforced concrete or a combination of both to attain the necessary strength and stiffness. Both of these approaches require a great deal of hand labor and material, and therefore, time to assemble and install, all of which renders them relatively expensive. It has been recognized that prefabricated, modular metal plates are relatively less expensive to produce, assemble and install, however, these plates exhibited severe strength limitations and could only be used for relatively small structures unless suitable stiffeners and supports were provided and unless the structure under consideration had the necessary shape to not only be self-supporting but to also support a payload. This latter aspect required that the structures be tubular and continuously arcuate as distinguished from U-shaped, or tubular with straight walls or the like even if the latter shape is more desirable for the structure under consideration.

SUMMARY OF THE INVENTION

The present invention seeks to overcome the above-discussed shortcomings of the prior art by providing as a structural building element a prefabricated, corrugated plate capable of supporting large loads without requiring stiffeners, support beams and the like as was necessary in the past.

Generally speaking, a corrugated, high strength structural steel plate constructed in accordance with the present invention comprises a plurality of parallel, longitudinally extending, generally sinusoidally shaped corrugations defined by alternating convex and concave peaks and troughs. The spacing between adjacent peaks and troughs in a direction perpendicular to the plate, or the depth of the corrugations, is at least about four inches. The spacing between adjacent peaks and adjacent troughs in a direction parallel to the plate, or the pitch of the plate, is at least about 12 inches. Furthermore, the peaks and troughs preferably have a curvature radius of at least about two inches.

This plate can be fabricated from flat metal stock supplied, depending on the thickness of the stock, either in coils or in relatively long, flat sections, normally of a length well in excess of about 12 feet, the longest prior art corrugated steel plate lengths that could be made by pressbraking sheet stock into a corrugated plate. Thus, the plate of the present invention can be fabricated in length of as much as 30 feet or more, depending on the ultimate use of the plate. Depending on the desired strength and rigidity of the corrugated plate the plate can be constructed from stock of any thickness. For applications such as for the construction of highway overpasses, bridges, tunnels and the like the plate can have a thickness of ⅜ to ½ inch and more.

In accordance with this invention, such plate is constructed by passing it through a plate corrugator such as is described and claimed, for example, in the inventor's U.S. Pat. No. 3,940,965 the disclosure of which is incorporated herein by reference. Since the plate is essentially continuously rolled in the corrugator described in the referenced patent the ultimate corrugated plate length can be chosen to suit a particular application and is not arbitrarily limited by the maximum length of available press-braking equipment.

Moreover, the rolling of the plate can be performed much more rapidly, all corrugations in a given plate being formed in a single pass of the sheet through the corrugator. In contrast thereto, heavy walled, e.g., up to ⅜ inch thick prior art corrugated plate having a corrugation pitch of up to six inches and corrugation depths of up to two inches required the individual forming of each corrugation in a press-brake. This process is time-consuming, costly and severely limits the size of the plate that can be fabricated in this manner. Consequently, corrugated plate, and particularly heavy walled corrugated plate having a corrugation pitch of 12 inches and more and a corrugation depth of four inches and more can be economically fabricated in accordance with the present invention by fabricating it in a corrugating mill of the type discussed in the above-referenced U.S. patent of the inventor.

In addition to the lower fabrication costs the fabrication of corrugated plate with the above set forth large corrugation pitch and depth enables the formation of relatively large peak and trough radii which allows one to coat and in particular to zinc coat the plate in its flat state and to corrugate it thereafter without cracking or otherwise damaging the zinc coating. This simplifies and economizes the coating process and therefore contributes to reducing the cost of the corrugated plate of the present invention.

The corrugated plate of the present invention not only simplifies the fabrication, assembly and installation of large load-bearing surfaces, it also has far superior strength and rigidity without requiring a correspondingly larger amount of material, e.g. sheet stock. For bending, the strength and rigidity of the plate is primarily determined by the corrugation depth. However, by simply increasing the corrugation depth substantially more material is required for a plate of a given size. Moreover, the manufacture of the plate becomes increasingly difficult, particularly for heavier wall thicknesses. The present invention increases the corrugation depth but also increases the pitch of the corrugation by a factor of about 2:1 or more over what was heretofore thought possible or advisable. As a result, the plate strength and rigidity is greatly increased over prior art plate, yet the plate of the present invention requires virtually no more material for a given plate size than prior art plate. In addition, the plate of the present invention can be given much larger curvature radii at its peaks and troughs which greatly facilitates its manufacture as discussed above.

Another aspect of the present invention contemplates a variety of structures which employ the corrugated plate of the present invention. Such structures include vertical retaining walls or bridge abuttment walls; bridge decking, single or multiple box culverts; gravel or like storage bins; bin type retaining walls, excavation retaining walls; and the like.

The advantages of the present invention are best illustrated on hand of an example, a 12 foot by 12 foot box culvert constructed of the 12 by 4 inch corrugated plate of the present invention as contrasted with a like box culvert constructed of reinforced concrete.

Such a box culvert constructed of the corrugated plate of the present invention for supporting a two-foot backfill cover and a California State H20 highway surcharge weighs approximately 685 lbs. per linear foot and costs, installed, approximately $275.00 per foot. A prior art concrete box culvert of the same dimension and capable of supporting the same load requires approximately three cubic yards of concrete and costs approximately $597.00 per linear foot completely installed, forms removed and concrete finished. Thus, the concrete box culvert is more than twice as expensive than the same culvert constructed in accordance with the present invention. Similarly, a 12×12 box culvert capable of withstanding a 20 foot backfill cover and a California State H20 highway surcharge constructed with the corrugated plate of the present invention weighs approximately 1890 lbs. per linear foot and costs approximately $756.00 per linear foot. The same culvert constructed of reinforced concrete requires approximately 5⅓ cubic yards of concrete per linear foot and costs approximately $1,066.00 per foot, or almost 50% more than the corrugated plate box culvert constructed in accordance with the invention. Similar cost savings can be achieved by employing the corrugated plate of the present invention for box culverts of different sizes as well as for other load-supporting structures as are more fully described hereinafter.

To illustrate the great strength and rigidity of the corrugated plate of the present invention, it is noteworthy that a 12 foot span (such as in a 12 foot box culvert) can carry a 40-foot backfill cover and a California State H20 highway surcharge. A reinforced concrete slab or a span of equivalent strength requires a vertical wall thickness for the abuttment of 12 inches and a (horizontal) slab thickness of about 18 inches.

The versatility of the present invention is not limited to the type of structure in which the corrugated plate can be used. The corrugated plate itself can be strengthened almost at will by securing aligned, respective peaks and troughs of the plate to each other with bolts, rivets and the like. The strength and rigidity can be further increased by providing spacers between the aligned peaks and troughs through which the securing means, e.g. the bolts extend. The interior spaces between the plates can further be filled with concrete with or without reinforcing bars so that the corrugated plates both form a structural member and a permanent exterior, load-bearing mold for concrete poured between the plates.

To illustrate the superior strength and rigidity of plate and plate structures made from the corrugated plate of the present invention, it is noteworthy that a reinforced concrete slab must have a thickness of nine inches and No. 7 reinforcing bars on six inch centers spaced seven inches from the top of the concrete bar to withstand the same bending moment as the plate of the present invention having a ½ inch wall thickness. Similarly, for two corrugated steel plates of the present invention bolted together peak-to-trough a concrete slab of equivalent bending strength requires a thickness of 15 inches, and No. 9 reinforcing bars on 5½ inch centers spaced 13 inches from the top of the slab. The comparison is even more dramatic when considering two corrugated plates constructed in accordance with the invention in which aligned peaks and troughs of the respective plates are spaced-apart by six inch spacers. A concrete slab of equivalent bending strength requires a thickness of 23 inches and No. 11 reinforcing bars on 5½ inch centers spaced 21 inches from the top surface of the slab.

Another notable advantage of the present invention relates to the installation of large diameter pipe for thoroughfares, tunnels or the like. In the past, such pipe was constructed of corrugated sheet having a corrugation depth and pitch of up to two by six inches and wall thicknesses of up to ⅜ inch. The weight and size of the pipe limited the maximum pipe diameter to about 26 feet beyond which assembly becomes unmanageable because of excessive plate flexibility and a resulting sagging and deformation of the pipe. To counteract such sagging and deformation the prior art suggested to employ pipe stiffeners as is set forth, for example, in U.S. Pat. No. 3,508,406. By constructing the pipe of the corrugated plate of the present invention, pipe diameters of as much as 75 feet can be assembled and installed without experiencing unmanageable pipe deflection and without requiring pipe supporting stiffeners. This is accomplished without any significant increase in the linear weight of the pipe because the linear weight of the corrugated plate of the present invention is substantially the same as the linear weight of prior art corrugated plate of the same wall thickness.

In sum and substance, therefore, the present invention provides as a new building element corrugated plate of the above stated configuration which exhibits superior strength characteristics as compared to any corrugated plate heretofore known or suggested. Moreover, this plate is more economically fabricated than prior art corrugated plate of much lesser strength by combining superior fabrication methods with a plate configuration which increases the plate strength without correspondingly increasing the material consumption, that is, the amount of material required for fabricating a plate of a given size.

Furthermore, the corrugated plate of the present invention enables the construction of a large variety of load-bearing, large surface area structures from relatively low cost, modular plate sections which are readily and relatively inexpensively assembled, e.g. bolted together and installed. Of equal importance, the present invention contemplates the assembly of two or more plates into structures of vastly increased strength and rigidity to satisfy virtually any application. Thus, the present invention is a most significant cost saving contribution to the construction industry.

DESCRIPTION OF THE PREFERRED EMBODIMENTS

Figure 1:
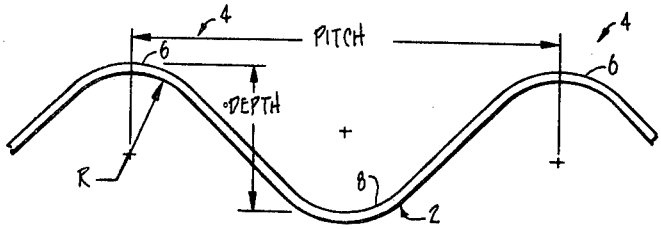
FIG. 1 is a fragmentary, cross-sectional view through a corrugated plate constructed in accordance with the present invention.

Referring first to FIG. 1, a corrugated plate 2 constructed in accordance with the present invention has a plurality of generally sinusoidal, parallel, longitudinally extending corrugations 4 which defines alternating convex peaks 6 and concave troughs 8. The corrugations have a pitch, that is adjacent peaks and adjacent troughs have a spacing (parallel to the sheet) of at least about twelve inches and the corrugations have a depth, that is a peak and an adjacent trough have a spacing (transverse to the sheet) of at least about four inches. The concave and convex peaks and troughs have a curvature radius R of at least about two inches and preferably of about two and one-quarter inches. The thickness of the plate may vary according to the ultimate use to which the plate is put and the strength required for such use. For most applications a plate thickness of no more than one-half inch suffices.

Figure 15:
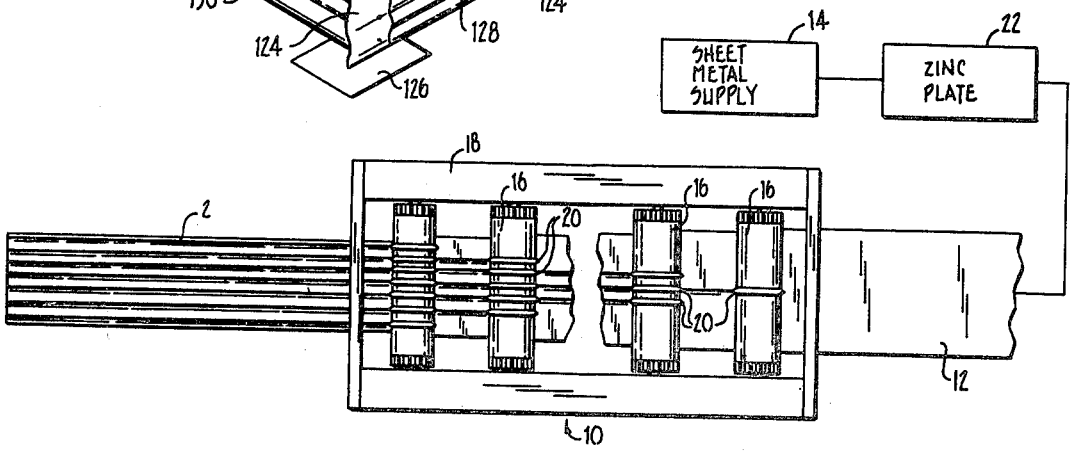
FIG. 15 is a schematic plan view of a corrugator employed for the fabrication of corrugated plate in accordance with the present invention.

Referring now briefly to FIG. 15, a corrugator 10 for forming a flat sheet metal stock 12 into a corrugated plate 2 comprises a sheet metal supply 14 and a plurality of serially arranged corrugating roller pairs 16 which consecutively form corrugations in the sheet from the center towards the lateral sides of the sheet. The rollers are mounted to a frame 18, which may be vertically adjustable, and they are driven by a suitable power drive (not shown in the drawings). The corrugating rollers have nesting annular corrugation rings 20 which deform the flat sheet stock into the corrugated plate illustrated in FIG. 1.

As briefly discussed above, the sheet stock may be supplied in discrete lengths or, normally for sheet stock of lesser thickness, in large coils which are continuously fed through the corrugator. Downstream of the corrugator the corrugated plate may be severed into pieces of lesser length if desired.

When the plate is to be coated, and particularly when it is to be zinc coated or galvanized, for example, with a three ounce coating (1.5 oz. of zinc per square foot for each side of the plate) the coating can be performed at coating bath 22 before the plate is corrugated. This is possible because of the large curvature radius R of the convex peaks and convex troughs 6, 8 respectively, of the corrugated plate. This large curvature radius subjects the zinc coating to only minor stretching and compressing while the sheet is deformed in corrugator 10 and the coating can normally withstand it without cracking or peeling although it could not withstand the more severe stretching and compressing to which it would be subjected in the manufacture of conventional corrugated plate having a much smaller curvature radius of one inch or less. By galvanizing the plate in its flat state the handling of the plate is simplified and the galvanizing bath can be maintained smaller, both of which reduces the manufacturing costs and, therefore, the overall costs of the finished corrugated plate.

Turning now to a more detailed description of the manner in which the corrugated plate 2 of the present invention can be used, and referring first to FIGS. 7–10, to increase the strength and rigidity of the plate, two plates 2 can be secured to each other to form a double plate 24 by aligning respective peaks and troughs 6, 8 and intermittently securing the aligned peaks and troughs to each other with bolts 26, rivets or welds (not shown). Interior spaces 28 can be filled with concrete 30 and for that purpose the upper corrugated plate may be provided with a plurality of spaced-apart concrete filling holes 32 through which the fresh concrete can be introduced into the interior spaces. The concrete may be reinforced with conventional reinforcing steel bars 34 and 36 which may be oriented parallel or transversely, respectively, to the corrugations of the plate. For transverse steel bars suitable apertures are formed in the corrugations of the plates which is traversed by the bar; in FIG. 7 the lower plate.

To further increase the strength and rigidity of a double plate two corrugated plates 2 may be combined into a double plate 38 by placing tubular spacers 40 between aligned peaks and troughs 6, 8, respectively of the two plates and bypassing connecting bolts 42 or rivets (not shown) through the spacers to thereby secure the two plates to each other in a spaced-apart relationship. The length of the spacers is chosen to suit the particular application. As before, the hollow interior spaces between the plates may be filled with concrete with or without reinforcing bars (not illustrated in FIG. 8).

The spacers may comprise simple metallic tubes 44 (FIG. 9) which, preferably, include contoured ends 46 to snugly engage the two corrugated plates between which the spacers are disposed. Alternatively, the spacer may comprise a tubular concrete member 48 (FIG. 10) which also has contoured ends 50. The concrete spacer may further be fitted with an insert 52 that has female threads for engaging and securing a pair of bolts threaded into the insert from opposing ends of the spacer to thereby secure the corrugated plates 2 to the spacer and to each other.

Figure 2:
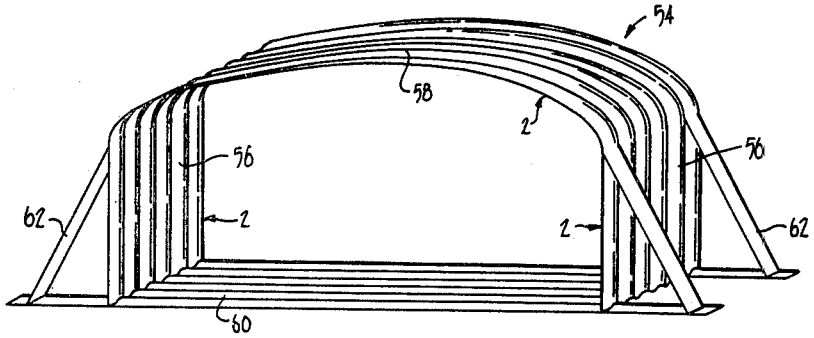
FIG. 2 is a perspective side elevational view of a large, load-bearing and buttressed support arch constructed in accordance with the present invention.

Referring now to FIG. 2 corrugated plates constructed in accordance with the invention may be assembled into a tubular or tunnel-like structure such as an arch 54 defined by upright sides 56 and a curved span 58 interconnecting upper ends of the sides. The sides and the span are constructed of one or more corrugated sheet sections which are conventionally connected end to end with bolts, rivets, by welding them together, or the like depending on the overall size and configuration of the arch. It should be noted that the arch as defined by the upright sides and the span extends over 180° and does not require the undercut configuration of many large prior art plate structures. The lower end of the sides may be directly anchored into the ground, it may be secured to suitable foundation slabs (not shown in FIG. 2) or they may be secured to a ground or anchoring plate 60. The anchoring plate may interconnect the lower ends of the sides, it may project past the sides and suitable reinforcing buttresses 62 may further be provided to steady the arch on and to securely tie it to the anchoring plate.

Figure 3A:
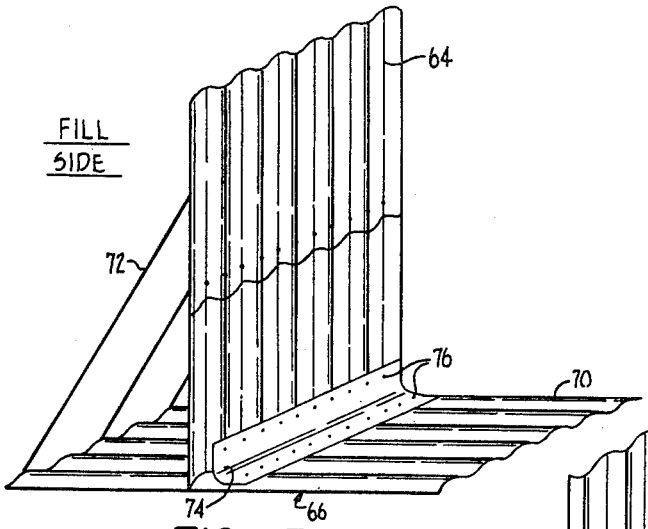
FIGS. 3A and 3B are fragmentary, side elevational, perspective views showing in greater detail the anchoring of the head or retaining wall illustrated in FIG. 3.
Figure 3:
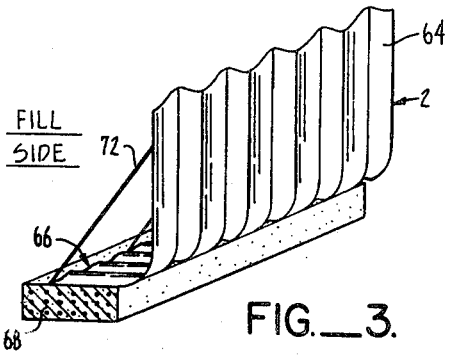
FIG. 3 is a perspective, elevational view of a head or retaining wall constructed with corrugated plate in accordance with the present invention.
Figure 3B:
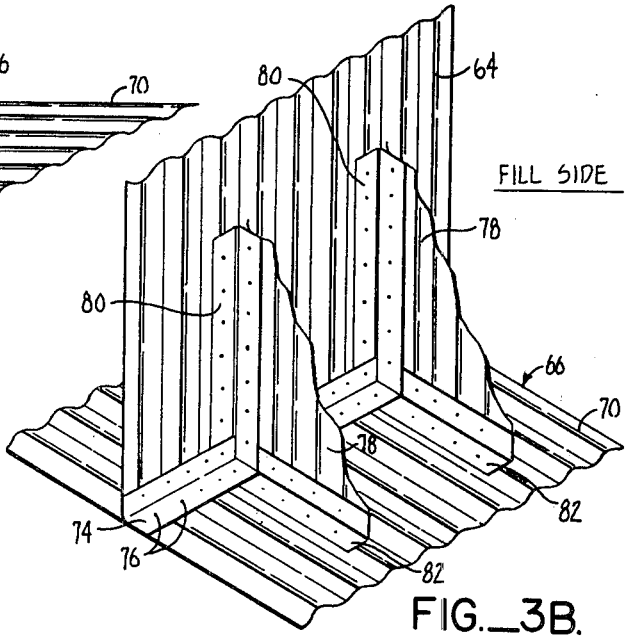

Referring now to FIG. 3 in another application the corrugated plate 2 of the present invention may be employed as a head or abuttment wall 64 having a general upright, e.g., vertical orientation. The lower end of the abuttment wall is attached to a footing 66 which may comprise a concrete slab 68 or corrugated anchoring plates 70 such as are illustrated in FIGS. 3A and 3B. Tie rods 72 may be provided to secure the abuttment wall to the footing and to strengthen the connection between the lower end of the wall and the footing.

Referring now specifically to FIGS. 3A and 3B, the lower end of the abuttment wall is secured to the corrugated anchoring plate 70 with an angle iron 74 that contacts protruding peaks of the wall and the anchoring plate, respectively, and that is secured thereto with bolts or rivets 76 or suitably applied welds. The tie rods illustrated in FIG. 3A may be replaced with perpendicular, corrugated plate webs 78 which are also secured to the abuttment wall 64 and the anchoring plate 70 with suitably oriented and attached angle irons 80, 82, respectively.

Figure 4:
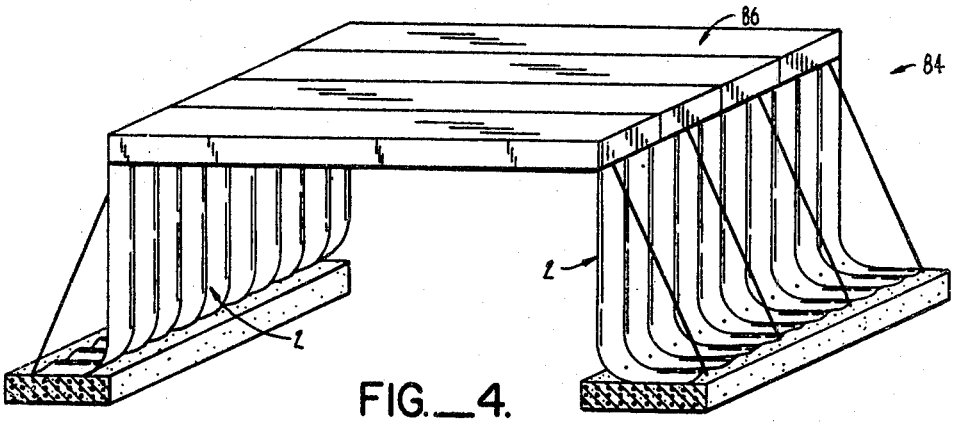
FIG. 4 is an elevational, perspective view of a bridge abuttment constructed in accordance with the present invention.
Figure 6:
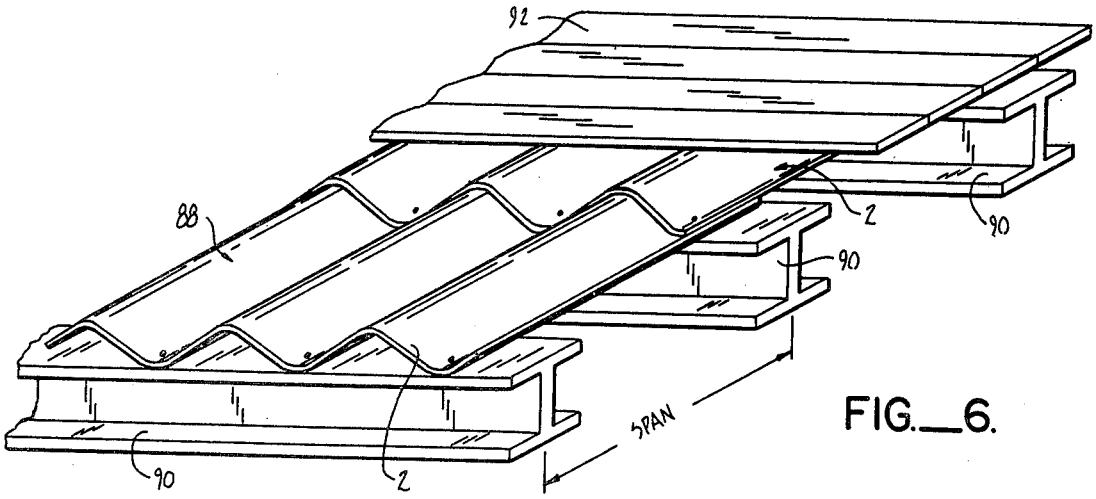
FIG. 6 is a front elevational, perspective view of decking constructed of corrugated plate in accordance with the present invention.
Figure 7:
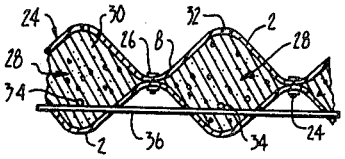
FIGS. 7 and 8 are fragmentary, cross-sectional views of double-plate walls or decks constructed in accordance with the present invention.
Figure 8:
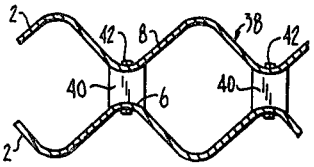
Figure 9:
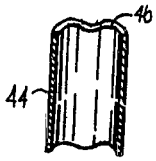
FIGS. 9 and 10 are perspective, side elevational, sectional views of spacers employed in the double-wall construction illustrated in FIG. 8.
Figure 10:
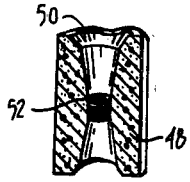

Referring now to FIGS. 3-4 and 6, the abuttment walls illustrated in FIG. 3 can be employed as a bridge abuttment 84 by positioning two abuttment walls opposite each other. The upper ends of the abuttment walls support a bridge decking 86 which may comprise flat corrugated plate decking 88 as illustrated in FIG. 6 which, depending on the distance between the abuttment walls, may be directly supported by the walls or by suitable steel girders 90 which in turn are carried by the upper ends of the abuttment walls. Placed on top of the corrugated plate decking are planks 92 or concrete which then form the flat roadway of the bridge.

Figure 5:
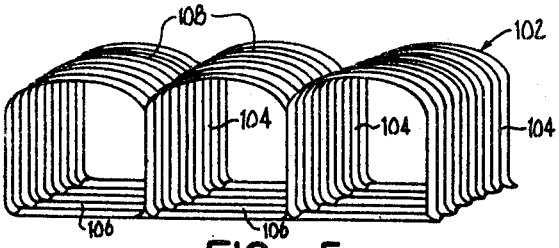
FIG. 5 is a schematic, perspective front elevational view of a multiple box culvert constructed with corrugated plate in accordance with the present invention.
Figure 5A:
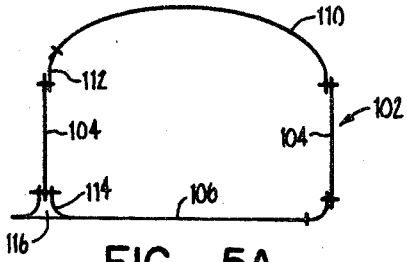
FIGS. 5A–5B are schematic details of the construction of the box culvert illustrated in FIG. 5.
Figure 5B:
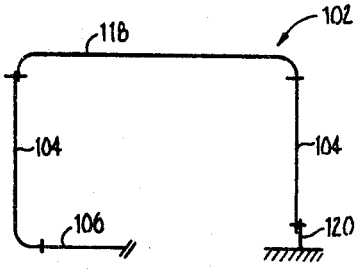
Figure 5C:
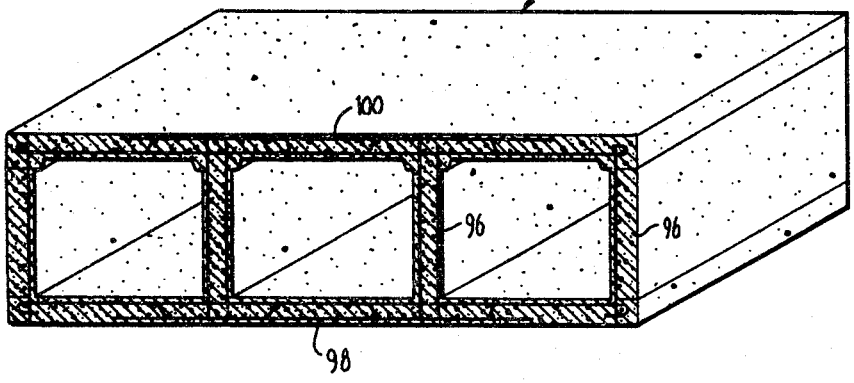
PRIOR ART FIG. 5C.
FIG. 5C is a schematic, perspective front elevational view of a prior art concrete box culvert.

Referring next to FIGS. 5-5C, FIG. 5C illustrates a multiple box culvert 94 constructed of reinforced concrete in accordance with the prior art and having vertical concrete walls 96 interconnected by a horizontally disposed reinforced concrete floor 98 and concrete top 100. FIG. 5 illustrates a multiple box culvert 102 constructed of corrugated plate 2 in accordance with the present invention. The box culvert is defined by upright sides 104 and a plurality of side interconnecting floor plates 106 and top plates 108, both of which are also constructed of the corrugated plate of the present invention.

FIGS. 5A and 5B illustrate alternate constructions of the box culvert 102. The box culvert illustrated in FIG. 5A has an arched top plate 110 secured to straight vertical side walls 112 directly (righthand side walls) or via a curved connecting plate 112 (lefthand side wall). The lower ends of vertical sides 104 are connected to the floor plate 106 via corner plates 114. A hollow space 116 formed by adjacent corner plates secured to interior sides 104 may be filled with concrete to add rigidity and mass to the box culvert.

FIG. 5B illustrates a box culvert section which has a flat top plate 118. In addition, the righthand portion of FIG. 5B illustrates a box culvert construction in which the vertical side 104 is secured to an upwardly opening channel anchored directly to the ground. In all other respects, the box culvert illustrated in FIG. 5B is identical to the one illustrated in FIG. 5A.

Figure 12:
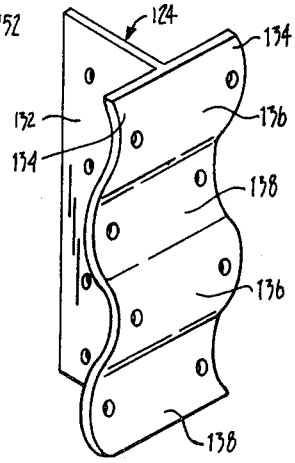
FIG. 12 is a perspective, front elevational view of a corner connector constructed in accordance with the present invention and employed in the bin illustrated in FIG. 11.
Figure 11:
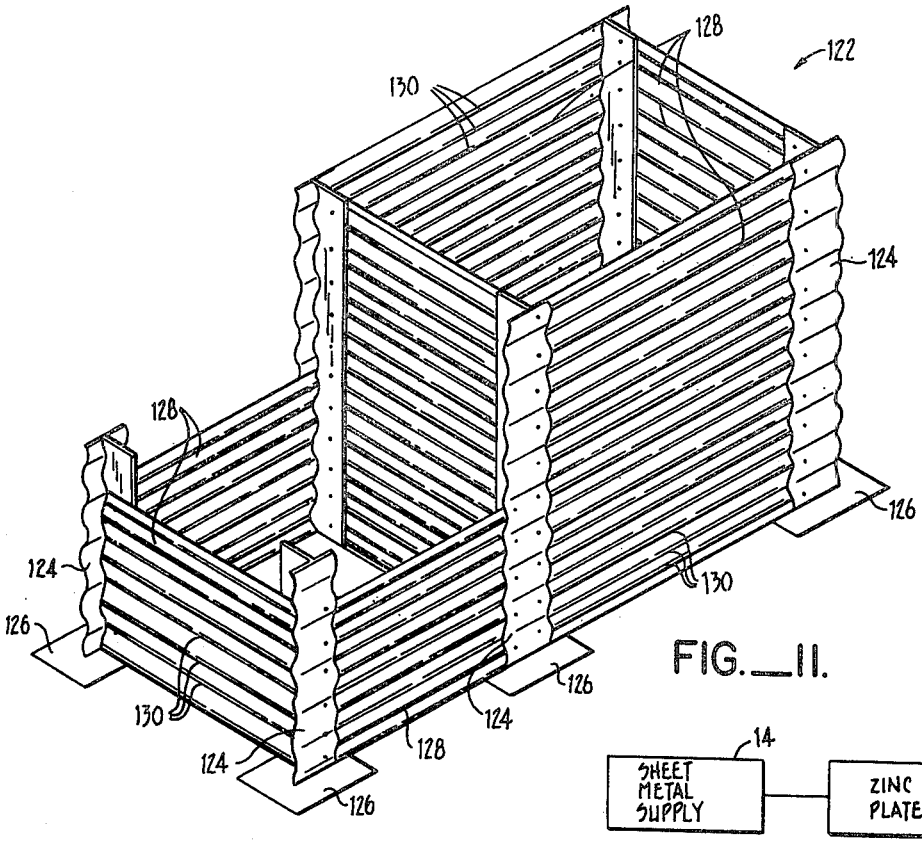
FIG. 11 is a fragmentary, side elevational view of bin type retaining wall for bulk materials constructed with corrugated plate in accordance with the present invention.

Referring to FIGS. 11 and 12, a storage bin 122 for bulk material such as a roadside gravel storage bin or bin type retaining wall comprises a plurality of rectangularly spaced-apart upright posts 124 carried by suitable anchoring or bearing plates 126 and mounting upright side walls 128 constructed of the corrugated plate of the present invention so that the plate corrugations 130 run horizontally between the upright posts. In this manner, the superior strength and rigidity as well as the large length and width of the corrugated plate of the present invention can be employed to greatly simplify the construction, assembly and installation of the bin type retaining wall as contrasted with prior art structures of this type constructed of U-shaped channels of a narrow width and assembled side by side to cover the full height of the bin type retaining wall.

The upright posts are preferably T-shaped members having a web 132 and a pair of legs 134 which protrude transversely from the web. At least the legs have an undulating configuration to define alternating peaks and troughs 136, 138 respectively, which have the same corrugation pitch and depth as the side walls 128 to form an improved post-to-side wall fit and to prevent relatively fluid bulk material (such as dry sand) from flowing from the bin through gaps that otherwise form between the corrugations of the side walls and the posts if the latter were constructed of flat T-shaped members. The webs may also be of an undulated construction, particularly for posts defining the outside corners of the bin.

Figure 13:
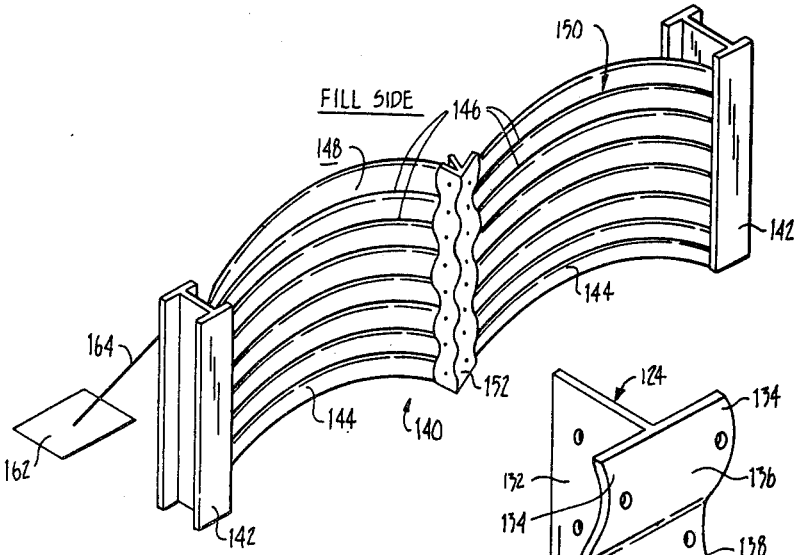
FIG. 13 is a perspective, side elevational view of a retaining wall constructed with corrugated plate in accordance with the present invention.
Figure 14:
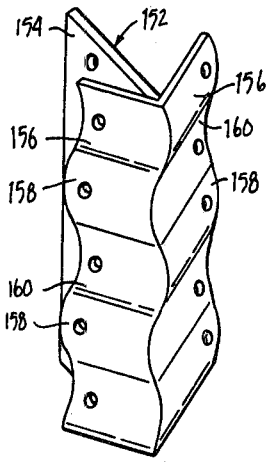
FIG. 14 is a perspective front elevational view of a column constructed in accordance with the present invention for use in connection with the retaining wall illustrated in FIG. 13.

Referring to FIGS. 13 and 14, a retaining wall 140 such as is commonly used in ground excavations to prevent bulk material like sand, ground, etc. from collapsing into the excavation comprises a plurality of uprights posts 142 and wall panels 144 spanning the distance between adjacent posts and having horizontally oriented corrugations 146, that is corrugations which are perpendicular to the posts. Depending on the type of material that is shored up by the retaining wall and the excavation depth, the panel may be flat (not shown in FIG. 13) such as the corrugated side walls illustrated in FIG. 11, or the wall panels may be arched with their concave sides 148 facing inwardly, that is facing towards the excavation 150. The posts may comprise conventional I-beams or, for applications in which the shored material is relatively fluid, fabricated, generally T-shaped members 152 having a web 154 and a pair of legs 156 which protrude transversely from the web. The angle of inclination of the legs from the web is the same as the angle of inclination of the ends of the wall panels 144. Furthermore, the legs are undulated to define alternating peaks and troughs 158, 160 which have a pitch and a depth that equals the pitch and the depth of the corrugated wall panels.

The posts are conventionally anchored, either by driving them to a sufficient depth into the ground or by providing suitably mounted anchor plates 162 and tie rods 164 connecting a portion of the post to the anchor plate.

I claim:

1. A load-supporting structure comprising at least one wall defined by a corrugated metal plate having a plurality of generally sinusoidal undulations defined by alternating, contiguous convex portions and concave portions, the spacing between adjacent concave and convex portions in a direction transverse to the plate being at least about four inches and the spacing between adjacent concave portions and between adjacent convex portions parallel to the plate being at least about 12 inches, a corrugated anchoring plate disposed transversely to the longitudinal extent of the undulations for anchoring an end of the first mentioned plate, the anchoring plate being shaped and dimensioned complementarily to the corrugated plate of the wall and oriented transversely with respect thereto, means securing lower ends of the wall to the anchoring plate bracing means connecting an upper portion of the wall with a portion of the anchoring plate remote from the lower end of the wall and comprising a corrugated bracing plate dimensioned complementarily to the wall and the anchoring plate and positioned perpendicular with respect to both, and means for securing the bracing plate to the wall at least adjacent an upper end of the wall.

2. A structure according to claim 1 wherein the anchoring plate comprises a continuous length of plate interconnecting the lower ends of adjacent walls.

3. A structure according to claim 1 including a separate anchoring plate for each wall member.

4. A structure according to claim 1 wherein the securing means for securing the lower end of the wall to the anchoring plate comprises an angle iron having substantially flat, perpendicular legs in contact with respective convex portions of the upright plate and the anchoring plate, and including means rigidly securing sections of the legs in contact with the portions to the portions of the plate and the wall.

5. A load-supporting structure according to claim 1 wherein the peaks and the troughs of the corrugations have a radius of curvature of at least about two inches.

* * * * *